US005697167A

United States Patent [19]

Kunz et al.

[11] Patent Number: 5,697,167

[45] Date of Patent: Dec. 16, 1997

[54] METHOD FOR DRYING A SUBSTANCE, IN PARTICULAR WOOD SHAVINGS

[75] Inventors: Werner Kunz, Lenzburg; Cyrill Hammer, Brugg, both of Switzerland

[73] Assignee: W. Kunz Drytec AG, Dintikon, Switzerland

[21] Appl. No.: 560,244

[22] Filed: Nov. 21, 1995

[30] Foreign Application Priority Data

Nov. 24, 1994 [CH] Switzerland ..... 3549/94

[51] Int. Cl.[6] ..... F26B 19/00

[52] U.S. Cl. ..... 34/86; 34/219; 34/79; 34/78

[58] Field of Search ..... 34/218, 219, 423, 34/425, 467, 493, 497, 513, 86, 77, 79

[56] References Cited

U.S. PATENT DOCUMENTS

| | | | |
|---|---|---|---|
| 3,936,951 | 2/1976 | Haueise et al. | 34/35 |
| 4,132,007 | 1/1979 | Voorheis | 34/35 |
| 5,237,757 | 8/1993 | Wiedmann et al. | 34/86 |
| 5,263,266 | 11/1993 | Schmidt | 34/79 |
| 5,271,162 | 12/1993 | Kunz et al. | 34/27 |

FOREIGN PATENT DOCUMENTS

| | | | |
|---|---|---|---|
| 1191299 | 4/1965 | Netherlands | 34/423 |

*Primary Examiner*—Henry A. Bennett
*Assistant Examiner*—D. Doster
*Attorney, Agent, or Firm*—Townsend and Townsend and Crew LLP

[57] ABSTRACT

In a process for drying a substance, particularly wood shavings, wood chips or wood flakes, a partial stream of the vapor-gas mixture is separated after passing through the drying drum before the vapor-gas mixture is led to a first heat exchanger. This separated partial stream is led through a supplementary heat exchanger before it is conducted into the combustion chamber of the furnace in which combustion takes place of the gases arising during the drying. The flue gases are led through the aforementioned supplementary heat exchanger before they reach the first heat exchanger whereby they are brought down to a lower temperature. In this way the thermal stress on the material of the heat exchanger elements of the first heat exchanger is reduced, thereby increasing the life of these heat exchanger elements.

8 Claims, 2 Drawing Sheets

METHOD FOR DRYING A SUBSTANCE, IN PARTICULAR WOOD SHAVINGS

BACKGROUND OF THE INVENTION

This invention relates to a method for drying a substance, in particular wood shavings, wood chips or wood flakes, in a drying drum.

During drying in a drying drum of wood shavings, wood chips or wood flakes in particular, the exhaust air emerging from the drying drum contains, in addition to water vapor, gaseous ingredients of wood as well as aerosols which cannot be released into the atmosphere without cleaning since the content of pollutants is too high. Thus the flue gas has to be cleaned, which can be accomplished by filtering, washing and/or regenerative thermal oxidation. An optimal cleaning of the flue gas would be achieved by combining these possibilities. Since these cleaning installations have to be added to the whole drying facility, this is an expensive solution, especially as the operation and maintenance of these additional installations is also costly.

Other possibilities have therefore been sought, a solution being found in which the vapor-gas mixture used as the drying medium is kept essentially in a closed loop. In this known method for drying a substance, disclosed in European Patent EP 0 457 203, a partial stream of the vapor-gas mixture is continuously separated off from the closed loop and is led to a condenser in which the liquid is condensed out while the gaseous mixture is led into the combustion chamber of a furnace. Combusted in particular in the combustion chamber are the hydrocarbons, so the flue gas cleaned in this way can be released into the atmosphere without any problems.

However, with this method, a condensate containing pollutants is left behind, which has to be disposed of. Moreover these pollutants are difficult to degrade, for example in a biological sewage treatment plant.

Another method for drying in particular wood shavings is disclosed in European patent EP-A-0 459 603. In this method a partial stream of the vapor-gas mixture is continuously separated out of the closed loop and is introduced directly into the combustion chamber. In the combustion chamber, where an appropriate temperature is maintained, the carbon monoxide contained in the introduced vapor-gas mixture oxidizes to carbon dioxide and the wood ingredients which are likewise contained in the vapor-gas mixture are oxidized at the same time. The condensation step is hereby omitted.

Thus, after passing through a first heat exchanger and after heating the vapor-gas mixture, the flue gas emerging from the combustion chamber, can, as a rule, be released directly into the atmosphere, without any visible smoke or any odors.

To achieve the aforementioned oxidation in the combustion chamber, a temperature of about 900° C. must be maintained. The combustible gas having this temperature is led to a first heat exchanger, in which the vapor-gas mixture conducted into the drying drum is heated to a temperature of about 500° C. It has been shown that on the side of the heat exchanger where the combustible gas enters, the first heat exchanger elements coming into contact with it are subjected to an extreme heat since the vapor-gas mixture located on the inside also has a temperature of already about 500° C. Consequently the demands placed upon the materials of these first-exposed heat exchanger elements are so great that these elements have a limited life.

SUMMARY OF THE INVENTION

An object of the invention is therefore to modify the known methods in such a way that the thermal stress on the heat exchanger elements is reduced and consequently the life of these elements increased.

This object is attained according to the invention with a method for drying a substance in a drying drum comprising the following steps:

- a flue gas heated in the combustion chamber of a furnace is led to a first heat exchanger in which a vapor-gas mixture is heated;
- the vapor-gas mixture heated in the said first heat exchanger is led in an essentially closed loop through the drying drum and afterward again through the first heat exchanger;
- a part of the vapor-gas mixture is separated from the loop prior to entering the said first heat exchanger, is led through a supplementary heat exchanger, and is introduced into the combustion chamber in which combustion takes place of the gases which arise during the drying;
- the heated flue gas emerging from the furnace, prior to being led into the first heat exchanger, is conducted through the supplementary heat exchanger, the separated part of the vapor-gas mixture being heated.

Since the heated combustible gas is led through a supplementary heat exchanger before entering the first heat exchanger, and is thus brought down to a lower temperature, the thermal stress on materials is reduced, especially of the first heat exchanger elements reached by this combustible gas.

Since this supplementary heat exchanger, into which the combustible gas having a high temperature is led, has the separated part of the vapor-gas mixture flowing through it, the materials of the heat exchanger elements of this heat exchanger are cooled to a relatively large extent from the inside, so the thermal stress on the materials thereof can likewise be kept correspondingly low.

Thus, with this modified method, the object of reducing the thermal stress on the materials of the heat exchangers is fully attained.

BRIEF DESCRIPTION OF THE DRAWINGS

The method according to the invention will be explained more closely in the following, by way of example, with reference to the accompanying drawing in which.

DESCRIPTION OF THE PREFERRED EMBODIMENTS

Figure 1:
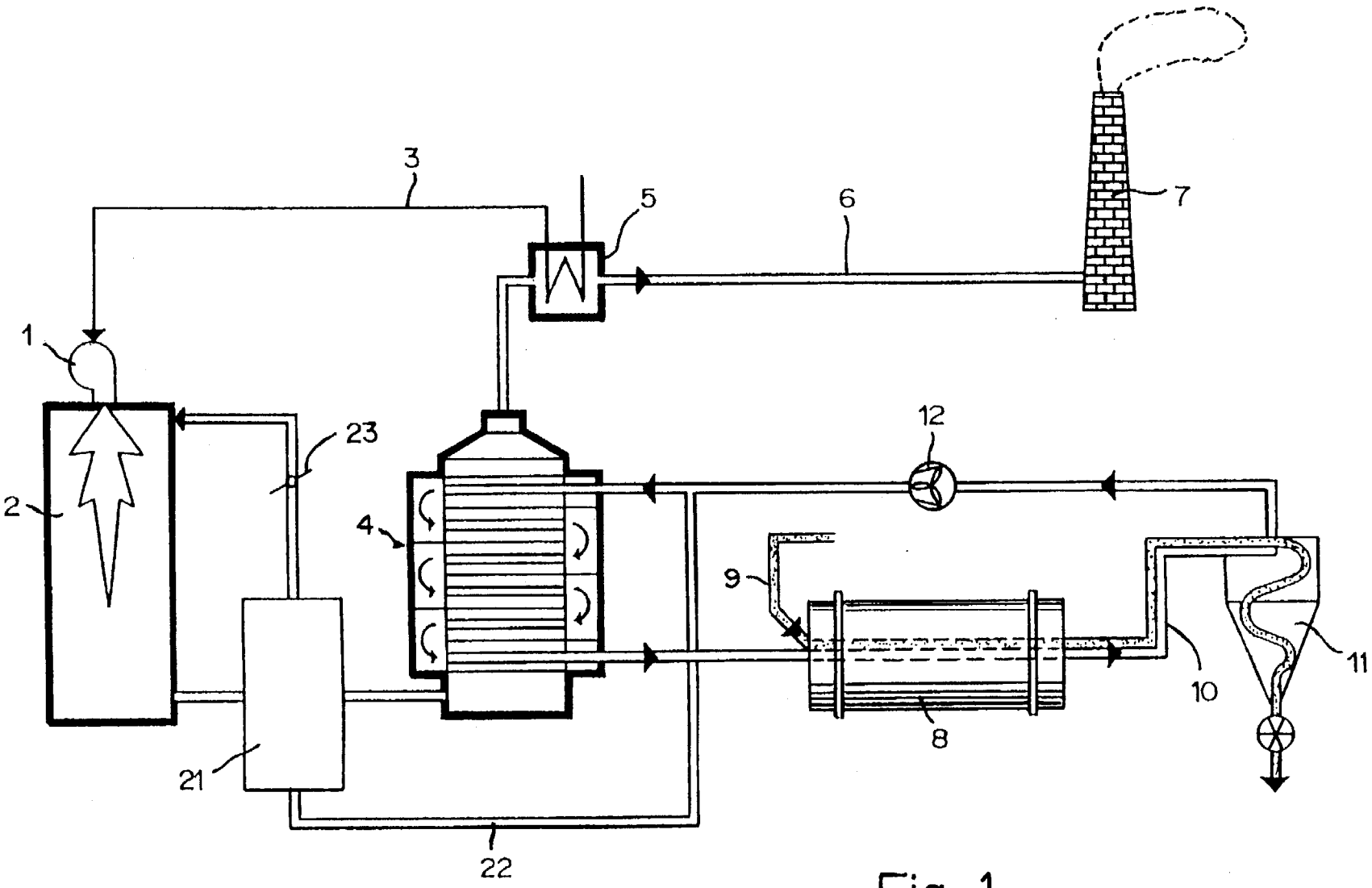
FIG. 1 is a diagrammatic view of the course of the inventive method in one possible embodiment.

According to the diagrammatic view of FIG. 1, a fuel is supplied to a furnace 1 in a known way, which fuel is combusted in the combustion chamber 2. The additional air supplied to this furnace 1, or respectively to the combustion chamber 2, is supplied through the supply pipe 3. The heated combustible gas, before being led through the first heat exchanger 4, passes through a supplementary heat exchanger 21. From the first heat exchanger 4, via a further heat exchanger 5, in which the additional air supplied to the furnace 1 is heated, and via a pipe 6, the additional air reaches a chimney 7 through which it is released into the atmosphere.

A vapor-gas mixture is heated in the first heat exchanger 4 by the combustible gas. The heated vapor-gas mixture is led to a drying drum 8 into which the substance to be dried is supplied via a supply inlet 9 in a known way. During the drying of wood shavings, for example, additional water vapor and wood ingredients in gaseous form and in the form of aerosols, such as, for example, volatile hydrocarbons, are delivered up to the vapor-gas mixture. The dried wood shavings and the vapor-gas mixture are led by way of a closed channel 10 to a cyclone separator 11 in which the dried wood shavings and the vapor-gas mixture are separated. Further processing of the dried wood shavings takes place in a known way.

The vapor-gas mixture is led back again to the first heat exchanger 4 with the aid of a fan 12. In this way there is a closed loop for the vapor-gas mixture.

Before the vapor-gas mixture is led to the first heat exchanger 4, a partial stream of the vapor-gas mixture can be separated via a pipe 22. This separated partial stream of vapor-gas mixture is led through the supplementary heat exchanger 21 after which it is conducted into the combustion chamber 2. A valve 23 is foreseen for flow regulation in a known way.

The combustible gas must reach a temperature of about 900° C. so that nearly complete combustion of all combustible gases can take place in the combustion chamber. In the supplementary heat exchanger 21 this combustible gas is cooled down to a temperature of about 750° C. after which it reaches the first heat exchanger 4. During passage through this first heat exchanger 4 a further cooling takes place to about 180° C., the vapor-gas mixture being heated up in this first heat exchanger 4 from about 130° C. to about 500° C.

Because of the lower temperature at which the combustible gas is introduced into the first heat exchanger 4, the thermal stress on the first heat exchanger elements, which come into contact with this combustible gas, is much lower than in the known methods described, the life of these heat exchanger elements being increased.

The separated partial stream of the vapor-gas mixture, which is led through the supplementary heat exchanger 21, causes the temperature of the combustible gas to be reduced from 900° C. to 750° C. With this, this separated part of the vapor-gas mixture is heated up from about 130° C. to about 370° C. Owing to the relatively low temperature of the separated partial stream of the vapor-gas mixture, the heat exchanger elements in the supplementary heat exchanger 21 are not heated as much even if they have the combustible gas at a temperature of 900° C. flowing around them. Thus in this supplementary heat exchanger 21, too, the thermal stress on the materials of the heat exchanger elements remains low and consequently a long life is achieved.

Therefore with the drying method according to the invention the thermal stress on the materials of which the elements of heat exchangers 4 and 21 are made is kept low, thereby increasing the life of these elements.

Figure 2:
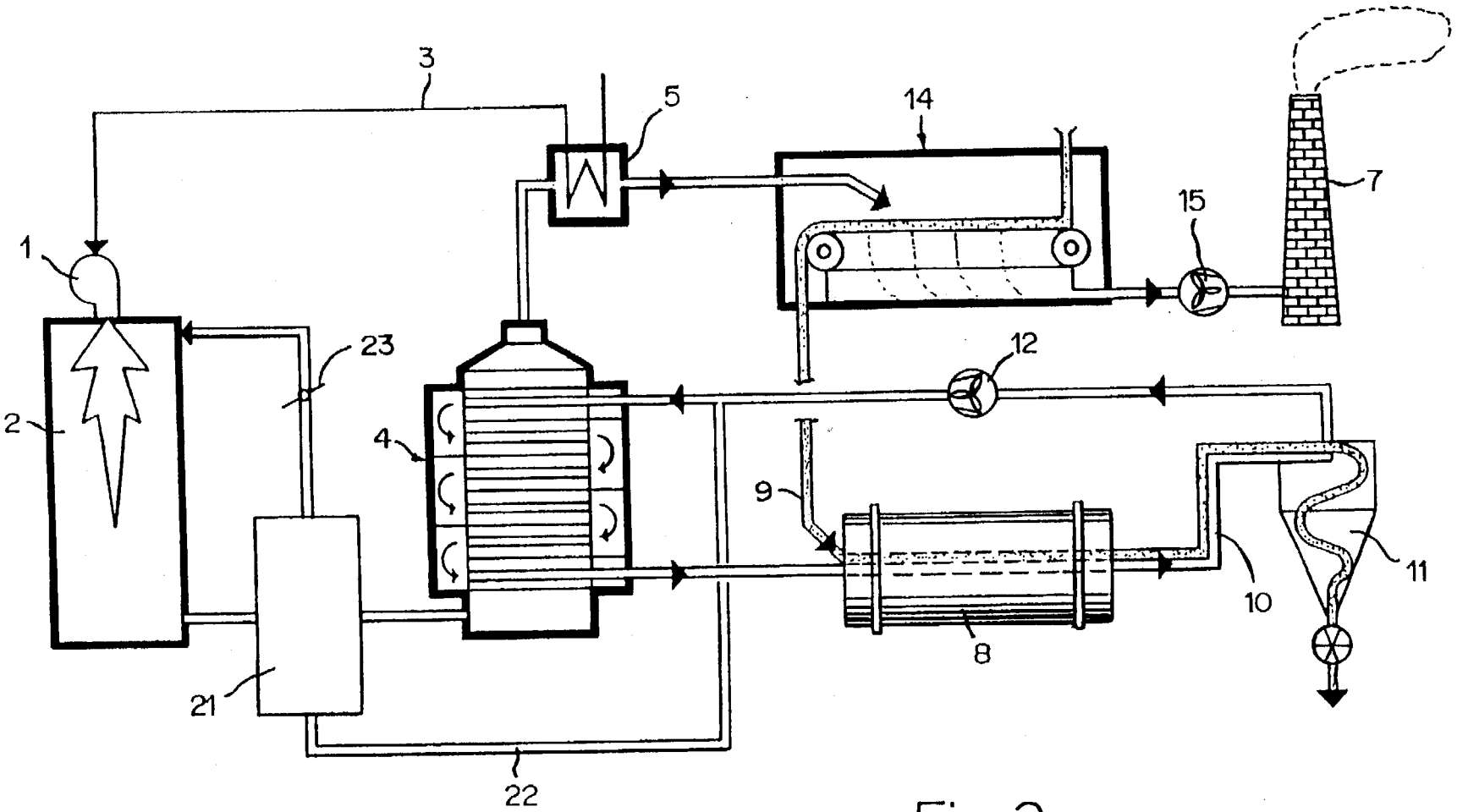
FIG. 2 is a diagrammatic view of the course of the inventive method according to FIG. 1 with pre-drying being provided.

The course of steps for drying wood shavings shown in FIG. 2 is basically the same as in FIG. 1, except that the flue gas from the further heat exchanger 5 flows through a pre-drying installation 14 and from there, via a further fan 15, is led to a chimney 7 for release into the atmosphere. The wood shavings to be dried are conveyed through this pre-drying installation 14 before they are led through the supply inlet 9 of the drying drum 8. In the pre-drying installation 14 the wood shavings are pre-heated to a temperature of about 75° C.

Owing to this pre-heating, less energy is needed for further drying to the desired extent of the wood shavings in the drying drum 8, which has the result that energy requirements as a whole are lower, whereby costs can be reduced.

To achieve the desired operating conditions, the facilities illustrated schematically in FIGS. 1 and 2 can be provided with the necessary control installations in a known way.

Besides wood shavings, wood chips or wood flakes, other substances can also be dried using the method according to the invention, such as, for example, grass, sugar beet chips or sludges of any kind.

What is claimed is:

1. A method for dying particles including wood without causing atmospheric pollution comprising the steps of:

providing a drying chamber and placing the particles in the chamber;

circulating a gaseous mixture including drying air through the drying chamber, the mixture having a drying temperature at which combustible aerosols are liberated from the particles so that a gaseous mixture which is recovered from the drying drum includes vapor and atmospheric pollutants;

generating a hot flue gas in a combustion chamber having a temperature sufficient to incinerate the pollutants;

branching off a portion of the recovered gaseous mixture, with the flue gas heating a remainder of the recovered mixture to the drying temperature before the remainder of the mixture is recirculated through the drum, and thereafter discharging the flue gas to the atmosphere;

using the portion of the mixture to lower the temperature of the hot flue gas to above the drying temperature before the heating step by transferring heat energy from the hot flue gas exiting the combustion chamber to the portion of the gaseous mixture to form a heated portion of the gaseous mixture;

directing the heated portion of the gaseous mixture into the combustion chamber; and combusting the pollutants in the heated portion of the gaseous mixture in the combustion chamber;

whereby the flue gas is substantially free of pollutants and does not cause atmospheric pollution.

2. A method according to claim 1 wherein the step of generating the hot flue gas comprises bringing the temperature of the flue gas in the combustion chamber to at least about 900° C.

3. A method according to claim 2 wherein the step of lowering the temperature of the flue gas comprises lowering its temperature to about 750° C.

4. A method according to claim 3 wherein the step of heating the remainder of the gaseous mixture comprises heating it to about 500° C.

5. A method according to claim 4 wherein the step of drying includes the step of reducing the temperature of the recovered gaseous mixture to about 130° C.

6. A method according to claim 5 wherein the step of transferring heat energy from the hot gas to the portion of the gaseous mixture is performed so that the heated portion of the gaseous mixture has a temperature of about 370° C.

7. A method according to claim 1 including the step of entraining the particles in the gaseous mixture flowing through the drying drum, and separating the particles entrained in the gaseous mixture recovered from the drying drum prior to the step of branching off the portion of the gaseous mixture.

8. A method according to claim 7 including the step of heating the particles prior to the entraining step with a portion of the flue gas previously used in the step of heating the remainder of the gaseous mixture to thereby lower the temperature of the flue gas prior to the step of discharging it to the atmosphere.

* * * * *